US012097938B2

(12) United States Patent
Godoy

(10) Patent No.: US 12,097,938 B2
(45) Date of Patent: Sep. 24, 2024

(54) DIVING MASK WITH ANTI-FOG CHARACTERISTICS

(71) Applicant: Cressi-Sub S.P.A., Genoa (IT)

(72) Inventor: Carlos Alberto Godoy, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 581 days.

(21) Appl. No.: 17/379,080

(22) Filed: Jul. 19, 2021

(65) Prior Publication Data

US 2022/0017190 A1 Jan. 20, 2022

(30) Foreign Application Priority Data

Jul. 20, 2020 (IT) ..... 102020000017590

(51) Int. Cl.
*B63C 11/12* (2006.01)

(52) U.S. Cl.
CPC ..... *B63C 11/12* (2013.01)

(58) Field of Classification Search
CPC ..... B63C 11/12; A61F 9/02
See application file for complete search history.

(56) References Cited

U.S. PATENT DOCUMENTS

2018/0015990 A1* 1/2018 Godoy ..... B63C 11/12

* cited by examiner

*Primary Examiner* — James C. Jones
(74) *Attorney, Agent, or Firm* — Blank Rome LLP

(57) ABSTRACT

A diving mask (1) comprising a rigid frame (101), at least one lens (102, 103), and a face mask (104) made of soft and elastically yielding material fixed to the rigid frame (101), where the face mask (104) has at least one opening (106, 107) for positioning at least one lens (102, 103), a front hollow projection (112) for housing the nose of the diver and a rear perimeter profile (105) applicable sealingly to the face of the diver so as to delimit an internal space (113) between said mask (1) and the face of the diver adapted to contain the nose and eyes of the diver, where the face mask (104) has a means for cooling the damp air exhaled from the nose of the diver for the dehumidification thereof before reaching the at least one lens (102, 103).

13 Claims, 4 Drawing Sheets

DIVING MASK WITH ANTI-FOG CHARACTERISTICS

RELATED APPLICATIONS

This application claims benefit of priority of Italy Application No. 102020000017590, filed Jul. 20, 2020. The above-identified related application is incorporated by reference.

FIELD OF USE

The present invention relates to a diving mask with anti-fog characteristics.

BACKGROUND OF THE INVENTION

Diving masks have been on the market for some time, composed of a pair of lenses (or a single lens) supported by a rigid frame onto whose profile the so-called face mask is fixed, formed by a sort of cap of soft and elastically yielding material, equipped with openings for the lenses and whose rear profile is applied in an airtight way to the face of the diver thanks to a strap that surrounds the head of the diver.

However, between the face of the diver and the mask, an internal space remains which is increased by a cavity projecting to house the nose of the diver.

Therefore, the eyes and nose of the diver are closed within the mentioned face mask while his/her mouth remains outside the face mask and can be connected to a cylinder through a mouthpiece.

The mask can also be used for free diving.

It is known that, in either case, although the nose is not used for breathing, it is inevitable that a small amount of damp air leaves the diver's nose and this damp air can cause the lenses to fog up, hence reducing the diver's visual ability.

As is known, various attempts have been made to reduce the onset of lenses fogging up, mainly through special treatments of the internal surface of the lenses, the effect of which is not always long-lasting and satisfactory.

EP 3269629 A1 shows a diving mask with an anti-fog system.

Therefore, the need is perceived to improve the structure of known diving masks provided with anti-fog systems.

SUMMARY OF THE INVENTION

The technical task of the present invention is to provide a diving mask that prevents the drawback of fogging up complained of in the prior art.

Within the context of this technical task, an object of the invention is to provide a diving mask that has anti-fog properties with a simple and cheap construction and production method.

The technical task, as well as these and other aims, are achieved according to the present invention by providing a diving mask comprising a rigid frame, at least one lens, and a face mask made of soft and elastically yielding material fixed to said rigid frame, said face mask having at least one opening for positioning said at least one lens, a front hollow projection for housing the nose of the diver and a rear perimeter profile applicable sealingly to the face of the diver so as to delimit an internal space between said mask and the face of the diver adapted to contain the nose and eyes of the diver, characterised in that said face mask has a means for cooling the damp air exhaled from the nose of the diver for the dehumidification thereof before reaching said at least one lens.

Advantageously said cooling means comprises internal and/or external finned surfaces of said face mask.

Advantageously said internal finned surfaces delimit a channel for the damp air exhaled from the nose of the diver along a tortuous path having gradual cooling surfaces where said damp air deposits moisture before reaching said at least one lens.

Advantageously said channel separates said front hollow projection for housing the diver's nose from said at least one positioning opening of said at least one lens.

Said internal finned surfaces may be formed by flexible sealing lips having a base attachment end to the internal rear surface of said face mask and a free apical end.

Said external finned surfaces may be defined by a plurality of fins ordered in parallel planes.

In a possible embodiment said plurality of fins are substantially parallel to a lying plane of said at least one lens.

Advantageously said finned surfaces are made as a single moulded part with said face mask.

BRIEF DESCRIPTION OF THE DRAWINGS

Further characteristics and advantages of the invention will become more apparent from the following detailed description of an embodiment of the diving mask according to the invention, illustrated by way of non-limiting example in the accompanying figures, wherein.

DETAILED DESCRIPTION OF THE ILLUSTRATED EMBODIMENTS

Figure 1:
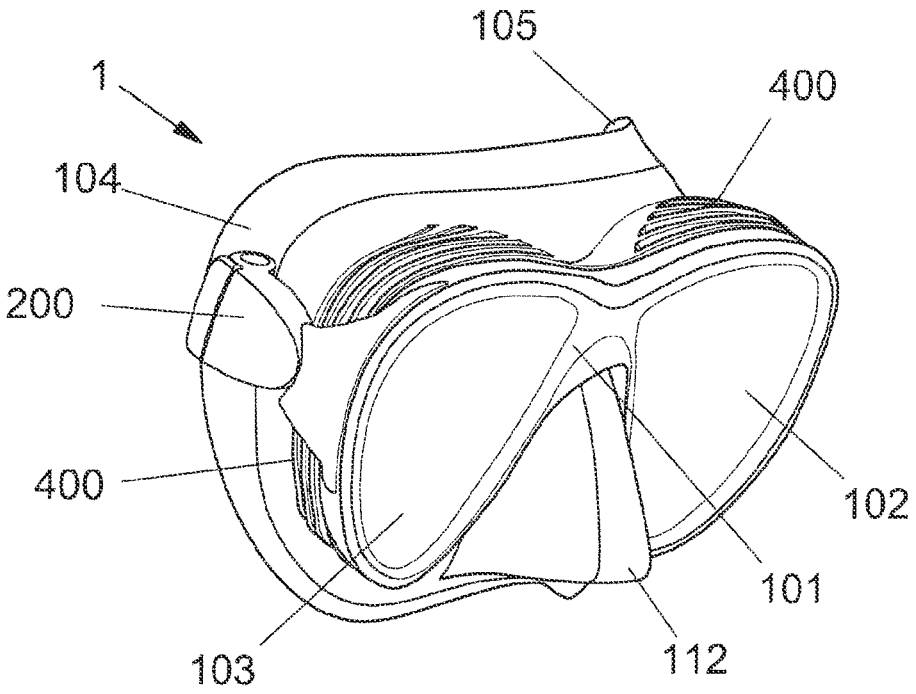
FIG. 1 shows an external perspective view of a diving mask according to the present invention.
Figure 2:
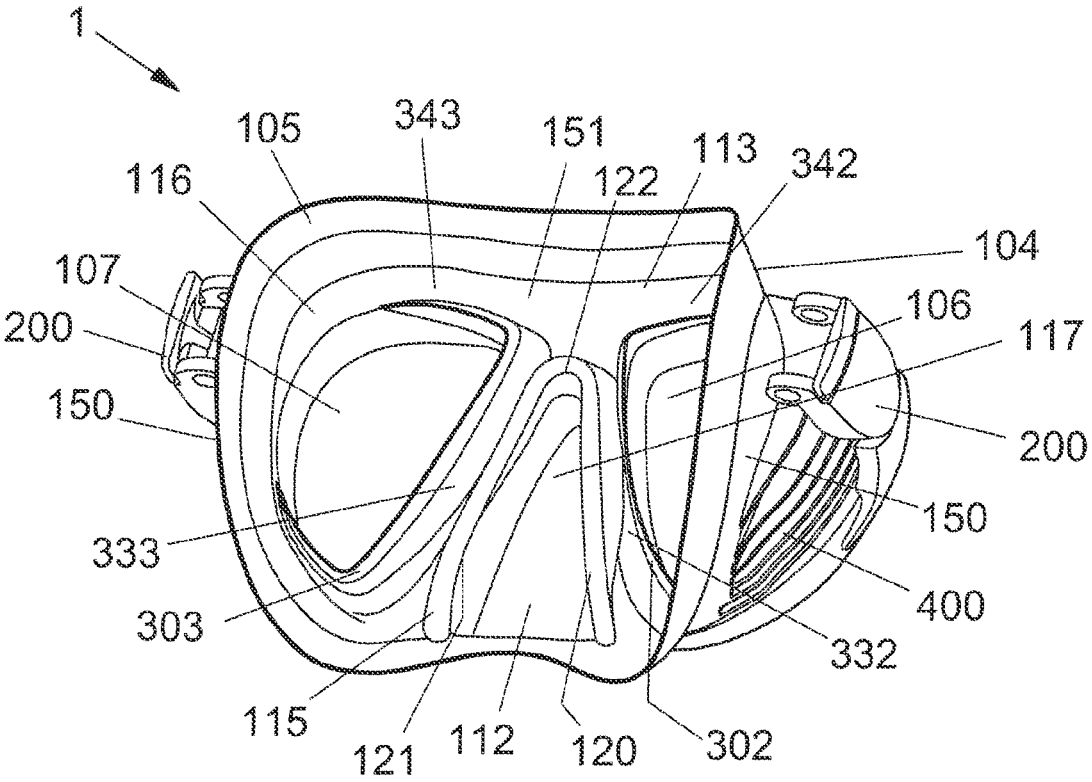
FIGS. 2 and 3 show an internal perspective view of the mask, and FIG. 3 in particular highlights with directional arrows the dehumification path of the damp air.
Figure 3:
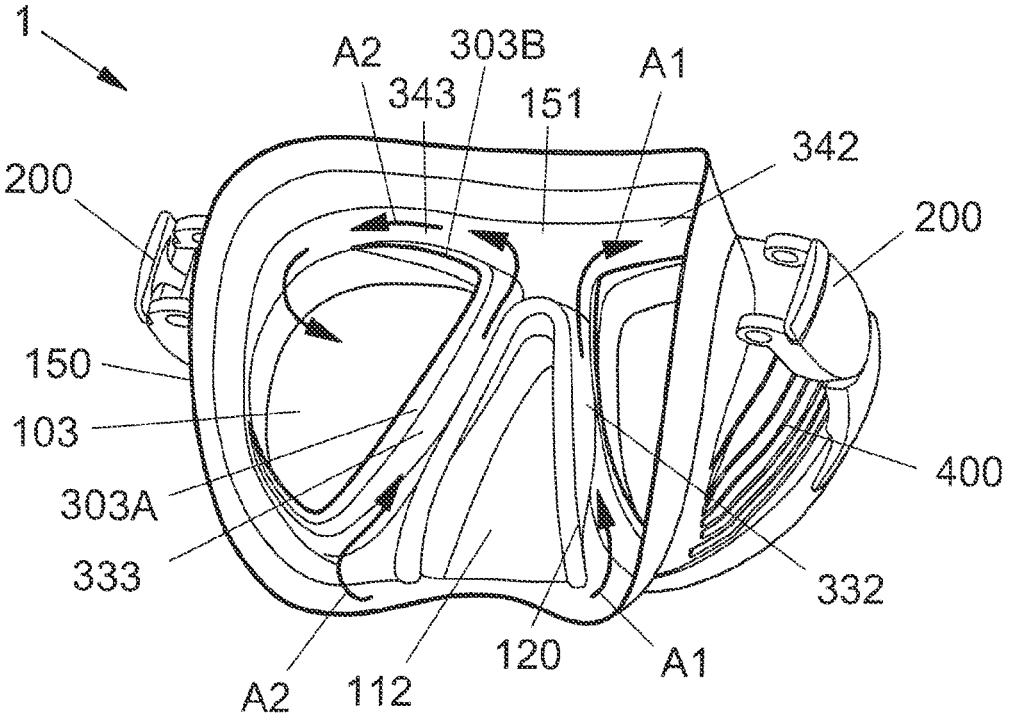
Figure 4:
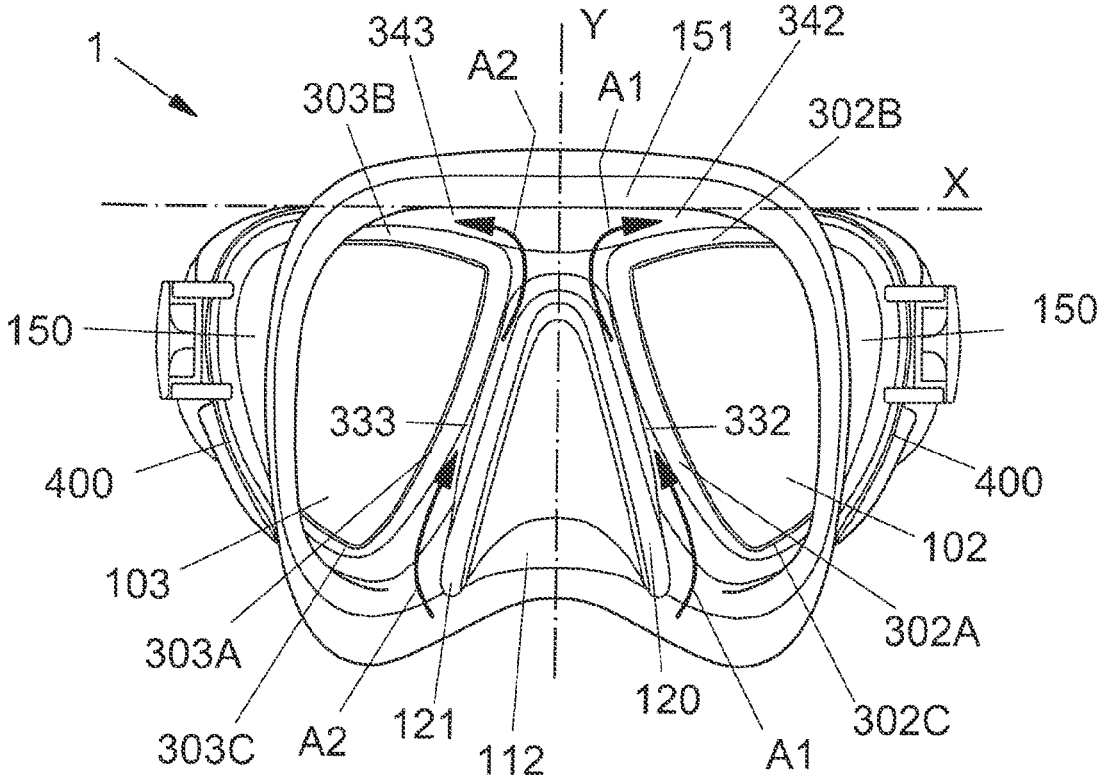
FIG. 4 shows an internal rear view of the mask in which the dehumification path of the damp air is highlighted with directional arrows.
Figure 5:
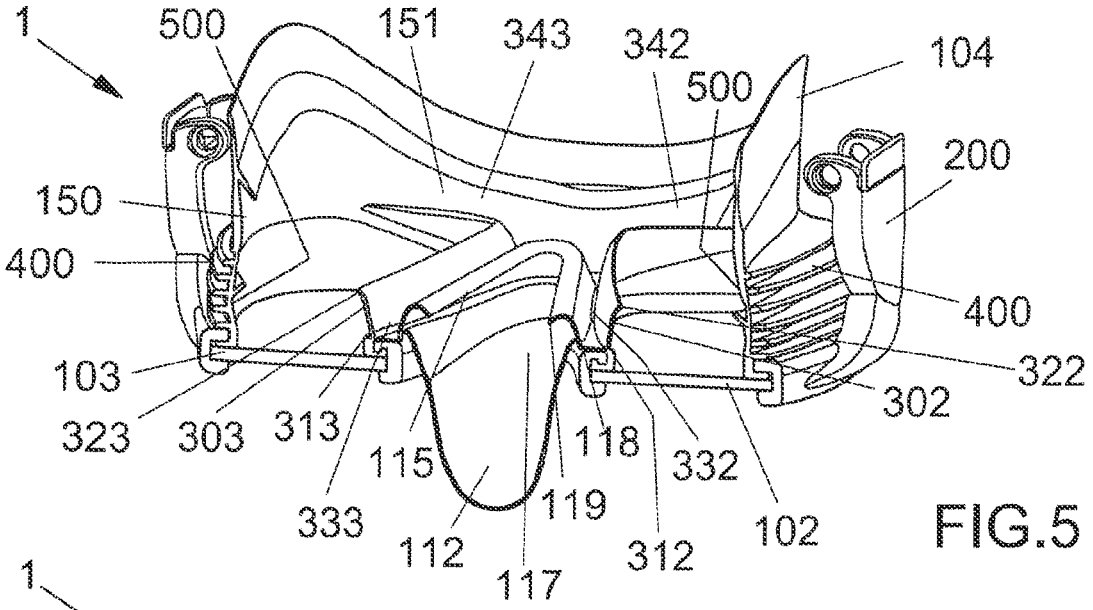
FIG. 5 shows an internal perspective view sectioned on a horizontal section.
Figure 6:
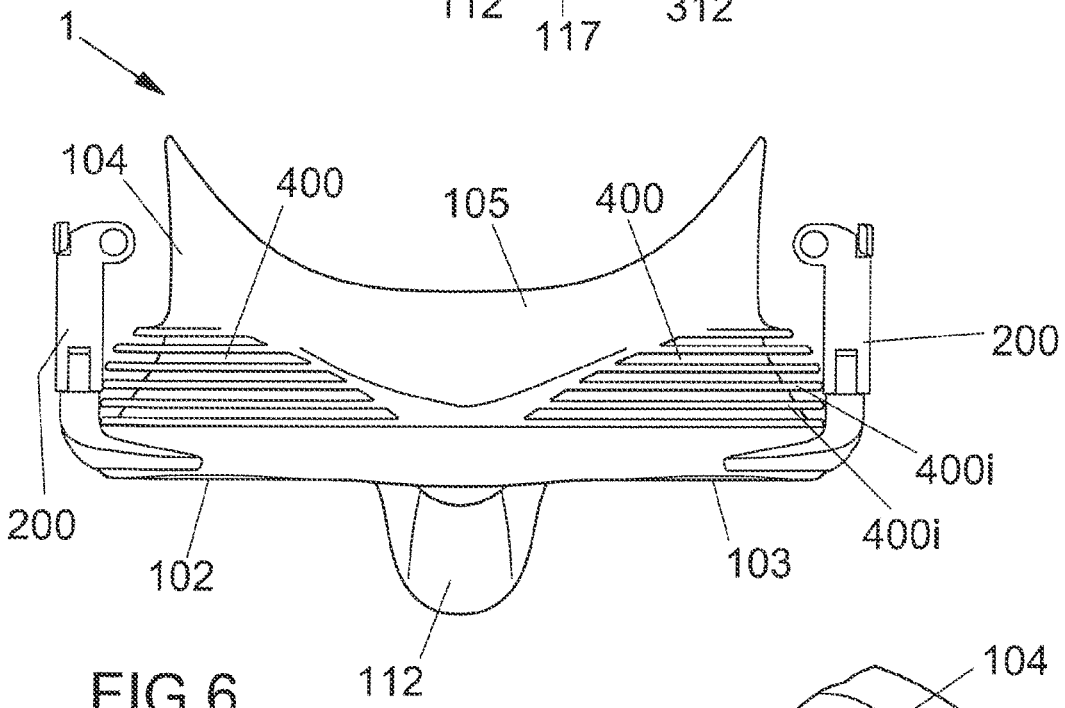
FIG. 6 shows an upper view of the mask.
Figure 7:
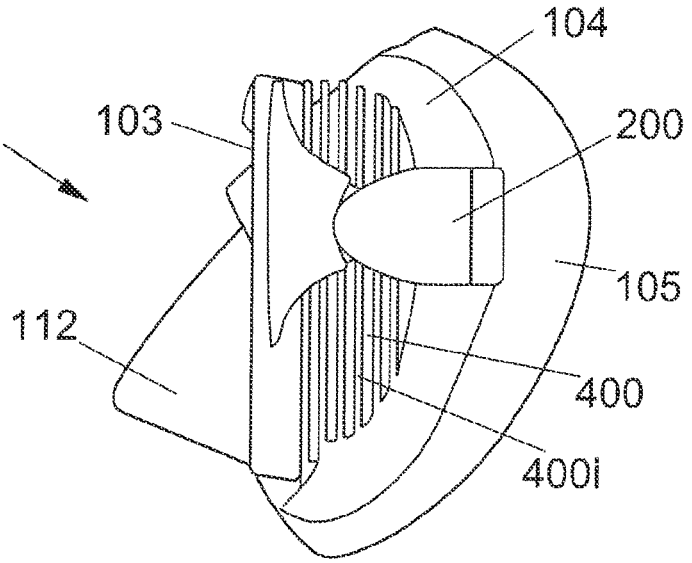
FIG. 7 shows a lateral view of the mask.
Figure 8:
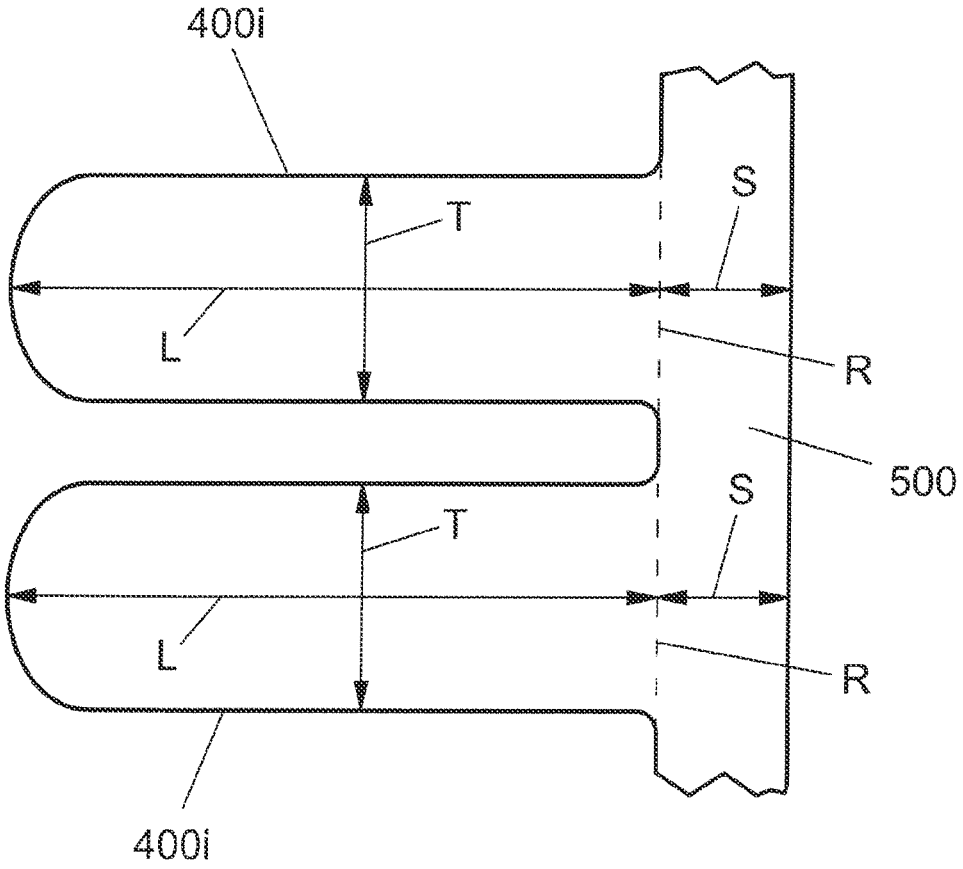
FIG. 8 shows an enlarged section of some extenal fins of the face mask, highlighting a suitable proportioning thereof.

With reference to the figures mentioned, a diving mask is shown indicated overall with the reference number 1.

The diving mask 1 comprises a rigid frame 101, a single lens or, as in the case illustrated, a separate right lens 103 and left lens 102, a face mask 104 made of soft and elastically yielding material fixed to the frame 101, and has a rear perimeter profile 105 applicable sealingly to the face of the diver so as to delimit an internal space 113 between the mask 1 and the face of the diver adapted in particular to contain the nose and eyes but not the mouth of the diver.

The face mask 104 also has side buckles 200 for hooking the adjustable fastening strap to the diver's head for retaining the mask 1 on the face (strap of the known type, and for illustration simplicity purposes not shown in the figures).

The face mask 104 has a front hollow projection 112 for housing the nose of the diver, and at the front for each lens 102, 103 a corresponding positioning opening 106, 107.

Advantageously the face mask 104 has a cooling means for cooling the damp air exhaled from the diver's nose for the dehumidification thereof before reaching the lens or the lenses 102, 103.

The cooling means comprises internal and/or external finned surfaces of the face mask 104.

The internal finned surfaces delimit a channel for the damp air exhaled from the nose of the diver along a tortuous path having gradual cooling surfaces where the damp air deposits moisture before reaching the lens or lenses 102, 103.

The internal finned surfaces are formed in particular by flexible sealing lips 115, 302, 303.

One flexible sealing lip 115 surrounds the front hollow housing projection 112 of the nose.

The flexible sealing lip 115 is configured so as to divide the internal space 113 between the mask 1 and the face of the diver, into a first zone 116 behind the lenses 102, 103 and a second zone 117 including the front hollow projection 112 for housing the nose.

The flexible sealing lip 115 is advantageously made during the moulding step as a single piece with the face mask 104.

The flexible sealing lip 115 has a base end 118 for attachment to the rear surface of the face mask 104 and a free apical end 119.

The free apical end 119 is folded over, advantageously but not necessarily folded over towards the inside of the second zone 117, so as to create an adequate sealed contact with the diver's face.

The flexible sealing lip 115 has a height, meaning the distance between its base end 118 and its apical end 119, which increases gradually in the direction from the lower edge to the upper edge of the face mask 104.

In particular, the flexible sealing lip 115 extends at least in part along the perimeter edge of the front hollow projection 112 for housing the nose.

With reference to the illustrated mask 1 having two separate lenses 102 and 103, a flexible sealing lip 115 is provided having two converging lateral sections 120, 121 connected by a transversal upper section 122.

Advantageously, according to the present invention, the inner surface of the face mask 104 also has at least one pair of flexible sealing lips 302 and 303, symmetrical with respect to the vertical middle axis Y of the mask, which partially circumscribe the positioning openings 106 and 107, respectively, of the corresponding lenses 102 and 103.

The flexible sealing lips 302 and 303 are configured to partially compartmentalise the internal space 116 behind the lenses 102 and 103 between the mask 1 and the diver's face.

In the symmetrical flexible sealing lips 302 303, at least three sections can be identified, typically curvilinear, respectively 302A, 302B, 302C and 303A, 303B, 303C, which partially circumscribe the corresponding lenses 102 and 103.

The central sections 302A and 303A define the perimeter of the lenses 102 and 103 in the section proximal to the vertical axis of symmetry Y of the mask, and therefore in the most proximal section to the flexible sealing lip 115 defining the front hollow projection 112 for housing the nose.

The upper sections 302B and 303B define the perimeter of the lenses 102 and 103 in the upper section, whereas the lower sections 302C and 303C define the perimeter of the lenses 102 and 103 in the lower section.

The symmetrical flexible sealing lips 302 and 303 are not present in the closing section of the perimeter of the lenses 102 and 103 further from the vertical axis of symmetry Y of the mask and therefore more proximal to the lateral wall 150 of the face mask 104.

The flexible sealing lips 302 and 303 are advantageously made during the moulding step as a single piece with the face mask 104.

The flexible sealing lips 302 and 303 have a base end 312 and 313 for attachment to the rear surface of the face mask 104 and to a free apical end 322 and 323, respectively.

The free apical end 322 and 323 is folded over, advantageously but not necessarily folded over towards the inside of the internal space 116, so as to create an adequate sealed contact with the diver's face.

The flexible sealing lips 302 and 303 have a height—meaning the distance between the respective base ends 312 and 313 and the apical ends 322 and 323—in the sections 302A and 303A which is coordinated and coherent with the height of the flexible sealing lip 115 which increases gradually proceeding in the vertical direction according to the axis of symmetry Y from the lower edge to the upper edge of the face mask 104.

Such height in the sections 302B, 303B and 302C, 303C gradually decreases from the respective upper and lower ends of the sections 302A and 303A until being cancelled out in the direction and in proximity to the lateral wall 150 of the face mask 104.

Appropriately, the central section 302A of the symmetrical flexible sealing lip 302 defines a first channel 332 with the opposite and congruent section 120 of the flexible sealing lip 115; symmetrically, the central section 303A of the symmetrical flexible sealing lip 303 defines a first channel 333 with the opposite and congruent section 121 of the flexible sealing lip 115.

Such pair of first symmetrical channels 332 and 333 has a prevalently proximal axis to the vertical, parallel to the vertical axis of symmetry Y of the mask 1.

Appropriately, the upper section 302B of the symmetrical flexible sealing lip 302 defines a second channel 342 with the internal upper surface 151 of the face mask 104; symmetrically, the upper section 303B of the symmetrical flexible sealing lip 303 defines a second channel 343 with the internal upper surface 151 of the face mask 104.

Such pair of second symmetrical channels 342 and 343 has a prevalently proximal axis to the horizontal, orthogonal to the vertical axis of symmetry Y of the mask 1.

The finned surfaces are instead formed by at least one pack of fins 400 of a plurality of parallel fins 400*i* provided on the lateral walls 150 and the upper wall of the face mask 104.

Preferably, the parallel fins 400*i* project from a base layer 500 of the face mask 104, and have a maximum projecting length L comprised between 5 and 20 times the thickness S presented by the base layer 500 at the root R of the fins 400*i* and a maximum thickness T comprised between 2 and 5 times the thickness S presented by the base layer 500 at the root R of the fins 400*i*. This proportioning optimises the cooling effect of the damp air exhaled from the diver's nose.

Typically, the fins 400*i* are ordered in parallel planes and may be substantially parallel to a lying plane of at least one lens 102 or 103, and the pack of fins 400 is positioned to the rear, with respect to the front of the mask 1, of at least one positioning opening 106 or 107 of at least one lens 102 or 103.

Advantageously, the pack of fins 400 of a plurality of fins 400*i* is made during the moulding step as a single piece with the face mask 104.

The operation of the diving mask according to the invention appears clear from the description and illustration and, in particular, is substantially as follows.

When the mask 1 is worn by the diver, the two converging sections 120, 121 of the flexible sealing lip 115 are arranged along the lateral walls of the nose while the transversal section 122 is arranged around the root of the nose.

The flexible sealing lip 115, resting on the user's face, separates the first zone 116 from the second zone 117 of the internal space 113 between the mask 100 and the face.

The first zone 116 of the internal space 113 between the mask 100 and the face of the diver is formed by a single air chamber that extends continuously from the zone behind the right lens 102 to the zone behind the left lens 103 passing through the zone surmounting the transversal section 122 of the flexible sealing lip 115.

The symmetrical flexible sealing lips 302 and 303 are arranged to define most of the eyes of the diver, respectively right and left.

The flexible sealing lip 115 and the symmetrical flexible sealing lips 302 and 303 define within the zone 116 at least one pair of first channels 332 and 333, with a prevalently proximal axis to the vertical, and at least one pair of second channels 342 and 343, with an axis prevalently proximal to the horizontal.

In operating conditions of the mask 1 by the diver, the symmetrical sequences of the first channels 332 and 333 with the respective second channels 342 and 343 constitute means for channelling the damp air exhaled from the diver's nose into the zone 117 but drawn to the zone 116, where the flexible sealing lip 115 does not completely seal the diver's face with its lower part.

The damp air is guided along a tortuous path A1 and A2 which has gradual cooling surfaces, where the damp air deposits moisture before reaching the lens 102 and 103 in proximity to the inner surface of the lateral surface 150 of the face mask 104.

The pack of fins 400 external to the lateral surface 150 and to the upper surface and immersed in water at a lower temperature than the body temperature of the diver keeps the entire lateral surface 150 and upper surface of the face mask 104 at a lower temperature, further cooling the damp internal air which reaches the end of the tortuous path A1 and A2, further depositing moisture.

When the air reaches the lens 102 and 103 with moisture naturally reduced along the tortuous path A1 and A2 it has a lower amount of moisture which can condense on the surface of the lens, thus preventing fogging.

The flexible sealing lips 302 and 303 preferably only partially circumscribe the positioning openings 106 and 107 of the corresponding lenses 102 and 103 in order to promote the compensation of the pressure inside the mask created by the diver to prevent the crushing thereof against the face.

It has in practice been noted that a diving mask according to the invention is particularly advantageous having anti-fogging properties with a simple and cheap construction and production method.

A diving mask as conceived herein is susceptible of many modifications and variants, all falling within the scope of the inventive concept as defined by the claims; furthermore, all the details are replaceable by technically equivalent elements.

In practice, the materials used, as well as the dimensions, can be any according to the needs and the state of the art.

The invention claimed is:

1. A diving mask (1) comprising a rigid frame (101), at least one lens (102, 103), and a face mask (104) made of soft and elastically yielding material fixed to said rigid frame (101), said face mask (104) having at least one opening (106, 107) for positioning said at least one lens (102, 103), a front hollow projection (112) configured for housing a nose of a diver, and a rear perimeter profile (105) sealingly applicable to a face of the diver so as to delimit an internal space (113) between said mask (1) and the face of the diver adapted to contain the nose and eyes of the diver;

wherein said face mask (104) has a means for cooling damp air exhaled from the nose of the diver for the dehumidification thereof before reaching said at least one lens (102, 103); and wherein said cooling means comprises external finned surfaces of said face mask (104), said external finned surfaces being a single molded part with the face mask (104) and being defined by a plurality of parallel fins (400*i*) projecting from a base layer (500) of the face mask (104), where said parallel fins (400*i*) have a maximum projecting length (L) comprised between 5 and 20 times a thickness (S) presented by said base layer (500) at a root (R) of said parallel fins (400*i*) and have a maximum thickness (T) comprised between 2 and 5 times the thickness (S) presented by said base layer (500) at the root (R) of said parallel fins (400*i*).

2. The diving mask according to claim 1, wherein said cooling means further comprises internal finned surfaces of said face mask (104).

3. The diving mask according to claim 2, wherein said internal finned surfaces delimit a channel for damp air exhaled from the nose of the diver along a tortuous path (A1, A2) having gradual cooling surfaces where said damp air deposits moisture before reaching said at least one lens (102, 103).

4. The diving mask according to claim 3, said face mask (104) having a vertical axis of symmetry (Y) and an orthogonal horizontal axis (X), wherein said tortuous path (A1, A2) comprises in cascade a first section configured to convey damp air in a prevalently parallel direction to said vertical axis of symmetry (Y) of said face mask (104) and a second inclined section with respect to said first section for conveying the damp air in a prevalently parallel direction to said orthogonal horizontal axis (X) of said face mask (104).

5. The diving mask according to claim 4, wherein said first section of said tortuous path (A1, A2) extends in use between the nose and the eyes of the diver and said second section of said tortuous path (A1, A2) projects in use above the eyes of the diver.

6. The diving mask (1) according to claim 3, wherein said channel separates said front hollow projection (112) for housing the nose of the diver from said at least one positioning opening (106, 107) of said at least one lens (102, 103).

7. The diving mask (1) according to claim 3, wherein said internal finned surfaces are formed by flexible sealing lips having a base attachment end to the internal rear surface of said face mask and a free apical end.

8. The diving mask (1) according to claim 7, wherein said internal finned surfaces are formed by at least a first flexible sealing lip (115) configured to rest around at least most of the nose of the diver and at least one pair of second symmetrical flexible sealing lips (302, 303) configured to rest around at least most of the eyes of the diver.

9. The diving mask according to claim 2, wherein said internal and external finned surfaces are made as a single molded part with said face mask (104).

10. A face mask (104) made of soft and elastically yielding material for a diving mask (1) comprising a rigid frame (101) and at least one lens (102, 103), said face mask (104) having at least one opening (106, 107) for positioning said at least one lens (102, 103), a front hollow projection (112) configured for housing a nose of a diver, and a rear perimeter profile (105) sealingly applicable to a face of the diver;

wherein said face mask (104) has a means for cooling damp air exhaled from the nose of the diver for dehumidification thereof before reaching said at least one lens (102, 103); and wherein said cooling means comprises external finned surfaces of said face mask (104), said external finned surfaces being defined by a plurality of parallel fins (400*i*) projecting from a base layer (500) of the face mask (104), where said parallel fins (400*i*) have a maximum projecting length (L) comprised between 5 and 20 times a thickness (S) presented by said base layer (500) at a root (R) of said parallel fins (400*i*) and a maximum thickness (T) comprised between 2 and 5 times the thickness (S) presented by said base layer (500) at the root (R) of said parallel fins (400*i*).

11. The face mask (104) according to claim 10, wherein said cooling means further comprises internal finned surfaces of said face mask (104).

12. The face mask (104) according to claim 11, wherein said internal finned surfaces delimit a channel for damp air exhaled from the nose of the diver along a tortuous path (A1, A2) having gradual cooling surfaces where said damp air deposits moisture before reaching said at least one lens (102, 103).

13. The face mask (104) according to claim 12, wherein said internal finned surfaces are formed by flexible sealing lips.

* * * * *